US011414230B2

(12) United States Patent
Schikevitz

(10) Patent No.: US 11,414,230 B2
(45) Date of Patent: Aug. 16, 2022

(54) PARCEL PACKAGING SYSTEM AND METHOD

(71) Applicant: Siemens Logistics LLC, DFW Airport, TX (US)

(72) Inventor: Christopher Schikevitz, Mansfield, TX (US)

(73) Assignee: Siemens Logistics LLC, DFW Airport, TX (US)

( * ) Notice: Subject to any disclaimer, the term of this patent is extended or adjusted under 35 U.S.C. 154(b) by 113 days.

(21) Appl. No.: 16/854,090

(22) Filed: Apr. 21, 2020

(65) Prior Publication Data

US 2021/0323706 A1 Oct. 21, 2021

(51) Int. Cl.

| | |
|---|---|
| ***B65B 35/44*** | (2006.01) |
| ***B65B 9/10*** | (2006.01) |
| ***B65B 5/06*** | (2006.01) |
| ***B07C 3/00*** | (2006.01) |

(52) U.S. Cl.

CPC ..... *B65B 35/44* (2013.01); *B07C 3/008* (2013.01); *B65B 5/067* (2013.01); *B65B 9/10* (2013.01)

(58) Field of Classification Search

CPC ..... B65B 35/44; B65B 5/067; B65B 9/10; B65B 59/005; B65B 2210/02; B65B 2210/04; B07C 3/008; B07C 5/36; B07C 3/06

See application file for complete search history.

(56) References Cited

U.S. PATENT DOCUMENTS

| | | | | |
|---|---|---|---|---|
| 5,472,309 | A * | 12/1995 | Bernard, II | B65G 1/0485 414/807 |
| 6,877,297 | B2 * | 4/2005 | Armington | B65B 57/00 53/503 |
| 7,331,471 | B1 * | 2/2008 | Shakes | B07C 7/005 209/630 |
| 8,019,645 | B2 * | 9/2011 | Mattingly | G06Q 30/02 705/14.41 |
| 9,738,450 | B2 * | 8/2017 | Lyon | B65G 1/1378 |
| 9,751,693 | B1 * | 9/2017 | Battles | B25J 9/0093 |
| 10,118,723 | B2 * | 11/2018 | Clark | B65B 59/02 |
| 10,127,514 | B2 * | 11/2018 | Napoli | G06Q 10/083 |
| 10,669,098 | B1 * | 6/2020 | Terzini | G07F 17/0092 |
| 10,696,485 | B2 * | 6/2020 | Ratto | B65G 21/12 |
| 10,766,711 | B2 * | 9/2020 | Lundahl | B65G 43/10 |
| 11,045,840 | B1 * | 6/2021 | Parrish | B07C 5/36 |
| 11,084,065 | B1 * | 8/2021 | Parrish | B07C 5/3412 |
| 11,120,378 | B1 * | 9/2021 | Willard, III | G06Q 10/06316 |
| 2002/0178074 | A1 * | 11/2002 | Bloom | G06Q 10/08 705/26.81 |

(Continued)

*Primary Examiner* — Thomas M Wittenschlaeger

(57) ABSTRACT

A system for packaging parcels includes a plurality of parcel packaging stations associated with varying packaging volume capacities. The system further includes a tote delivery conveyor configured to provide transport links to the plurality of parcel packaging stations, for transporting thereto, a tote containing a batch of parcels sorted to a common destination. The system is configured to select a parcel packaging station for the batch of parcels, from the plurality of parcel packaging stations, based on an overall volume of parcels being sorted to that destination. The tote delivery conveyor is controllable to transport the tote containing the batch of parcels to the selected parcel packaging station.

20 Claims, 4 Drawing Sheets

(56) References Cited

U.S. PATENT DOCUMENTS

| | | | | |
|---|---|---|---|---|
| 2011/0295411 | A1* | 12/2011 | Rotella | G06Q 10/08 700/216 |
| 2011/0295412 | A1* | 12/2011 | Hara | G06Q 10/08 700/216 |
| 2011/0295413 | A1* | 12/2011 | Hara | G06Q 10/087 700/216 |
| 2013/0218799 | A1* | 8/2013 | Lehmann | G06Q 10/083 705/337 |
| 2014/0364998 | A1* | 12/2014 | Neiser | B65G 43/08 700/230 |
| 2018/0137459 | A1* | 5/2018 | Jacobs | G06Q 30/02 |
| 2018/0208346 | A1* | 7/2018 | Scaife | B65B 5/00 |
| 2019/0135461 | A1 | 5/2019 | Pippin et al. | |
| 2020/0376668 | A1* | 12/2020 | Russell | B25J 15/0616 |
| 2021/0039140 | A1* | 2/2021 | Geyer | B07C 3/008 |
| 2021/0133667 | A1* | 5/2021 | Wood | G06Q 10/087 |

* cited by examiner

PARCEL PACKAGING SYSTEM AND METHOD

TECHNICAL FIELD

The present disclosure relates generally to the field of mail and parcel processing, and in particular, to a system and method for packaging parcels sorted to a common destination.

BACKGROUND

Distribution logistics systems related to parcel delivery rely on sequences of sorting operations and transportation steps to move parcels incrementally across the logistic network from origin to destination. Typically, parcels are sorted according to commonality in the next step in transportation, which concludes in parcels being sorted to a delivery vehicle, from which they will be delivered along a shared delivery route in the final transportation sequence. The logistics systems also process a wide variation in sizes of parcels, for example, from parcels as small as 4 cubic inches to large freight, such as truck tires or palletized parcels. For processing, parcels are often assigned size classes. The size classes may include, for example, parcels smaller than normal, called "smalls," standard parcels, which are compatible with most of the processing capacity, and oversized parcels, which are variously known as "irregulars," "non-conveyables," "out of gauge," etc. Since the transportation for the different size classes is usually common, the parcels of all size classes are ultimately loaded onto the same trailers. In the case of the "smalls" size class, parcels of a common sorting destination are sometimes packaged together, which offers the means to save the labor to unload, sort, and load what would otherwise be individual parcels in all subsequent steps.

SUMMARY

Briefly, aspects of the present disclosure are directed to a technique for packaging parcels sorted to a common destination as a function of an overall volume of parcels being sorted to the destination.

According to a first aspect of the present disclosure, a system for packaging parcels is provided. The system comprises a plurality of parcel packaging stations associated with varying packaging volume capacities. The system further comprises a tote delivery conveyor configured to provide transport links to the plurality of parcel packaging stations, for transporting thereto, a tote containing a batch of parcels sorted to a common destination. The system is configured to select a parcel packaging station for the batch of parcels, from the plurality of parcel packaging stations, based on an overall volume of parcels being sorted to said destination. The tote delivery conveyor is controllable to transport the tote containing the batch of parcels to the selected parcel packaging station.

According to a second aspect of the present disclosure, a method for packaging parcels is provided. The method comprises receiving parcels sorted to a common destination in a tote. The method further comprises transporting the tote containing a batch of parcels sorted to the common destination on a tote delivery conveyor to a selected parcel packaging station from a plurality of parcel packing stations. The plurality of parcel packaging stations are associated with varying packaging volume capacities. The selected parcel packaging station is determined based on an overall volume of parcels being sorted to said destination.

Additional technical features and benefits may be realized through the techniques of the present disclosure. Embodiments and aspects of the disclosure are described in detail herein and are considered a part of the claimed subject matter. For a better understanding, refer to the detailed description and to the drawings.

BRIEF DESCRIPTION OF THE DRAWINGS

The foregoing and other aspects of the present disclosure are best understood from the following detailed description when read in connection with the accompanying drawings. To easily identify the discussion of any element or act, the most significant digit or digits in a reference number refer to the figure number in which the element or act is first introduced.

DETAILED DESCRIPTION

To enhance logistical efficiency of a parcel delivery system, multiple parcels of a smaller size class that are sorted to a common destination may be packaged together, to operate as a larger size class. For instance, a dozen or so parcels in the "smalls" size class (depending on the actual size of the parcels) may be packaged into a single bag having the size class of a standard parcel. Alternately, many more "smalls" parcels may be packaged into a single, pallet-sized carton, called a "gaylord," which is regarded as the largest size class ("irregulars," "non-conveyables," "out of gauge," etc.). The more parcels are that are comingled together, the greater the savings that can be achieved in subsequent processing. Sorting systems are generally designed for certain configurations of the output chutes of the sorter, so that the output chutes are positioned at the correct height and pitch for bags, gaylords, or output conveyors. Typically, this configuration is essentially permanent.

Aspects of the present disclosure are directed to a technique for providing multiple packaging modalities having varying packaging volume capacities, whereby a particular packaging modality may be selected for a batch of parcels being sorted to a common destination based on the overall volume of parcels being sorted to that destination. Illustrative embodiments of the present technique are described below.

Figure 1:
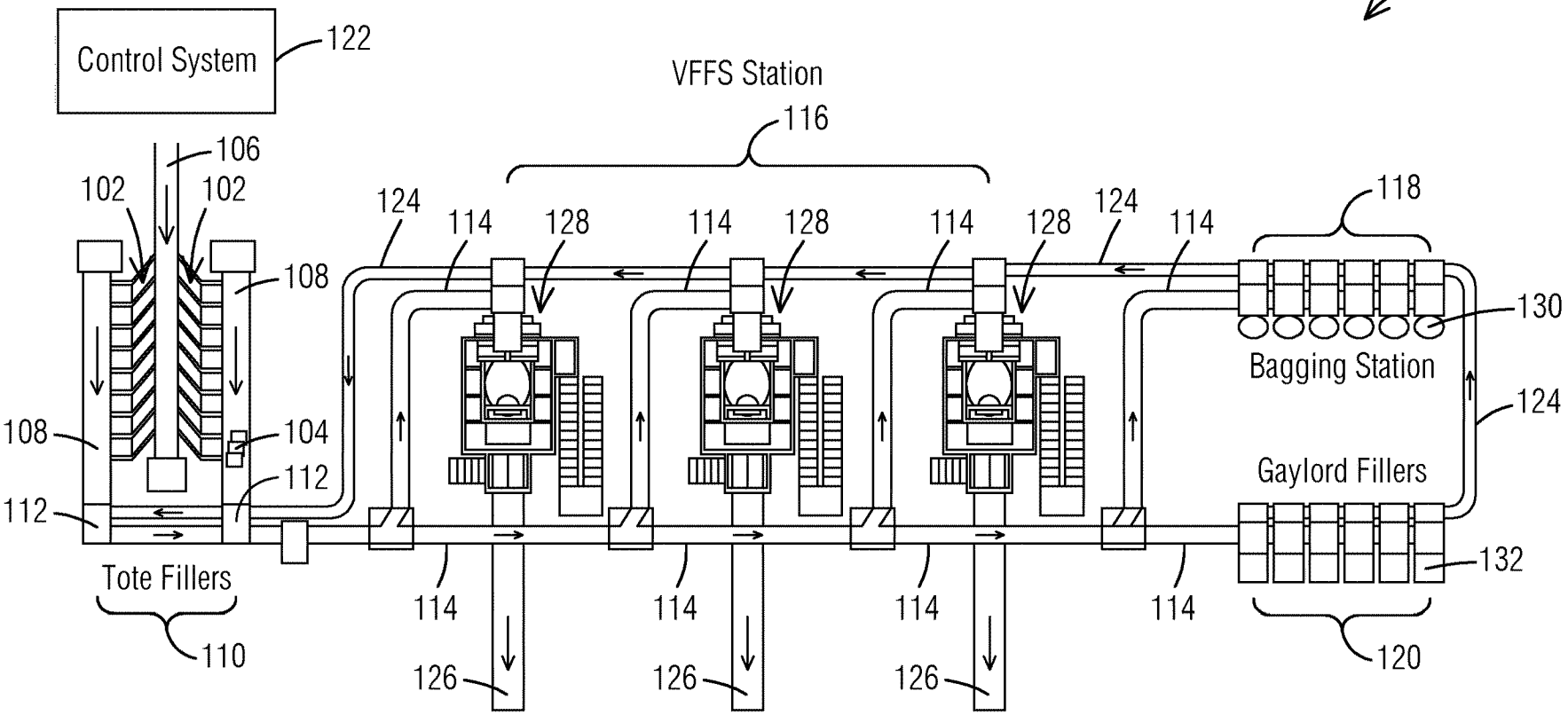
FIG. 1 is a simplified schematic diagram illustrating a system for packaging parcels according to an aspect of the present disclosure.

FIG. 1 depicts a parcel packaging system 100 in accordance with an illustrative embodiment. Here, parcels are received at an intake 102 from a sorter 106. The intake 102 may comprise, for example, one or more buffers, each buffer being configured to receive parcels sorted by destination from the sorter 106 and provide a controlled output to a gathering conveyor 108. The output from each buffer of the intake 102 is a batch of parcels 104 sorted to a common destination. The batch of parcels 104 is transported by the gathering conveyor 108 to a tote filling station 110. At the tote filling station 110, the batch of parcels 104 is transferred to a carrying container, referred to herein as a tote 112. In an alternate embodiment (not shown), parcels sorted to a common destination may be received from a sorter directly into a tote.

The tote 112 containing the batch of parcels 104 may be associated with a unique identifier linked to information regarding the destination of the batch of parcels 104. A tote delivery conveyor 114, herein comprising multiple conveyor sections, provides transport links between the tote filling station 110 and a plurality of parcel packaging stations 116, 118 and 120. The plurality of parcel packaging stations 116, 118, 120 have varying packaging volume capacities. Each of the plurality of parcel packaging stations 116, 118 and 120 thus provides a parcel packaging option associated with a different packaging volume capacity than the other.

The operation of the parcel packaging system 100 may be controlled by a control system 122. The control system 122 may be configured to determine or select a parcel packaging station 116, 118, or 120 for the batch of parcels 104 based on an overall volume of parcels being sorted to the destination. The overall volume of parcels sorted to the destination may be determined, for example, by employing a volumetric algorithm based on parcel size, volume, shape, etc. A high-volume destination would thus be well-suited to the largest available packaging option. The packaging option for the batch of parcels 104 may be determined using the unique identifier associated with the tote 112 containing the batch of parcels 104. The control system 122 may be configured to control the tote delivery conveyor 114 to transport the tote 112 containing the batch of parcels 104 to a selected one of the parcel packaging stations 116, or 118, or 120.

Figure 2:
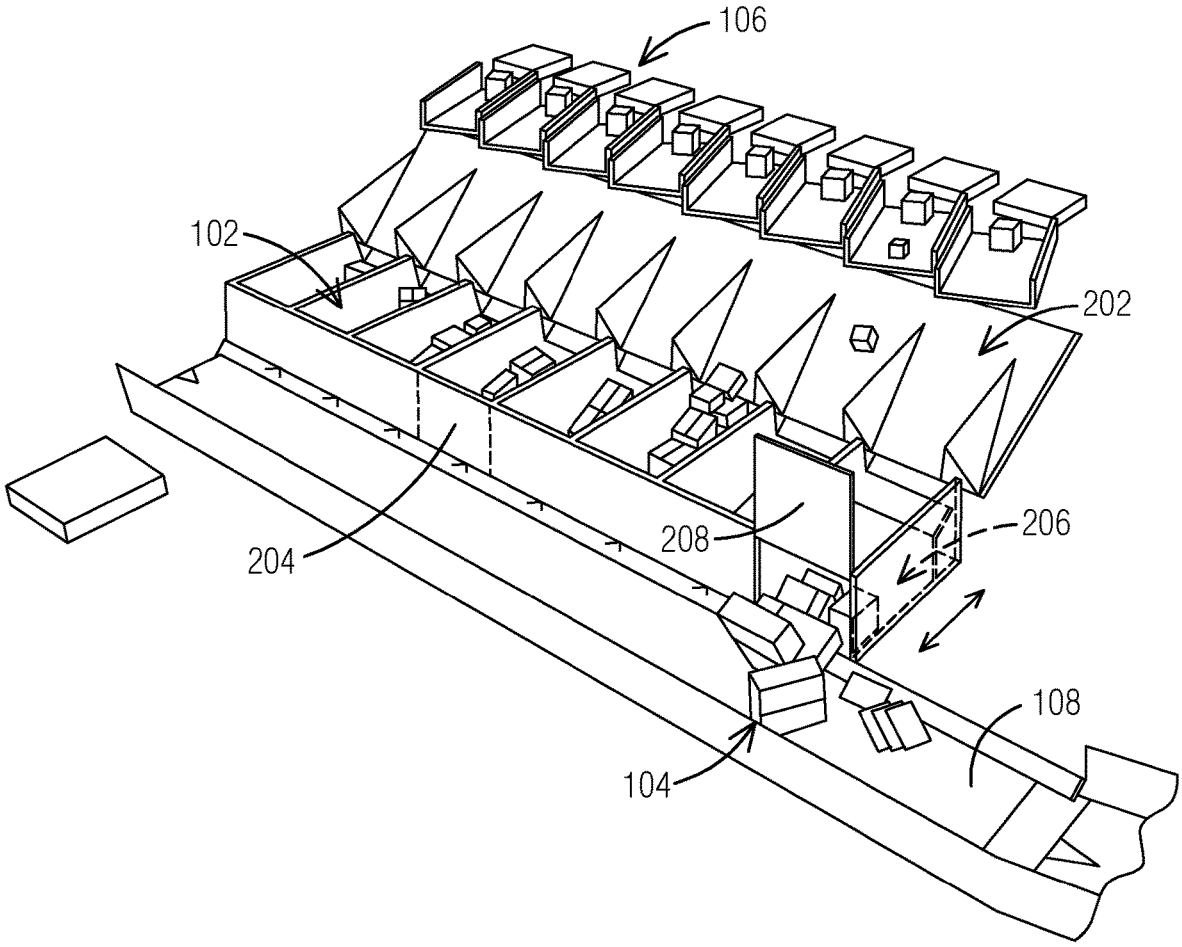
FIG. 2 illustrates an intake in accordance with an example implementation.

As shown in FIG. 2, the intake 102 may comprise a plurality of individually controlled buffers 204. Each buffer 204 defines an internal volume configured to receive parcels from the sorter 106 via a respective sorter output chute or tilt tray 202. The parcels in the sorter 106 may be sorted based on a sorting key assigned to each parcel. The sorting key of each parcel is uniquely associated with the destination of the parcel. Each buffer 204 may thereby receive parcels sorted to a common destination. Each buffer 204 comprises a reciprocating belt 206 and a door 208. The door 208 is controllable to open when a threshold volume of parcels is reached in the buffer. As the door 208 of a buffer 204 is opened to output a batch of parcels 104, the belt 206 pushes the batch of parcels 104 from the buffer 204 onto the gathering conveyor 108.

In the illustrative embodiment shown in FIG. 1, the parcel packaging stations include a vertical form fill seal machine station 116, a manual bagging station 118 and a gaylord filling station 120. After the tote containing the batch of parcels arrives at the selected parcel packaging station, the batch of parcels is transferred from the tote to a package for subsequent handling. In case of the vertical form fill seal machine station 116, the batch of parcels is transferred from the tote to a vertical form fill seal machine 128, which forms a film packaging to containerize the batch of parcels and delivers the package to an output conveyor 126. In case of the bagging station 118, the batch of parcels is transferred from the tote to a bag 130. Likewise, in case of the gaylord filling station 120, the batch of parcels is transferred from the tote to a gaylord 132.

The overall volume of parcels being sorted to a destination is typically greater than the volume of a single batch of parcels assigned to the destination. In at least some of the packaging modalities, especially those associated with higher packaging volume (e.g., gaylords), multiple batches of parcels sorted to a common destination may be transferred to a single package in the above-described manner, before the package is transported.

Post packaging of the parcels sorted to a common destination, a label may be generated for the package which allows the package to be handled as a single item in the transportation system. The label would typically identify the geographic location of the destination (e.g., zip code) but may also contain additional human-readable information, such as sort location inside the delivery truck, customer name, tracking ID, dimensions and weight of the parcels, etc.

After being unloaded at the selected parcel packaging station, the empty totes may be transported by a tote return conveyor 124 to the tote filling station 110 to be re-used.

In the illustrative embodiment, the bags 130 at the manual bagging station 118 are associated with the smallest packaging volume capacity, the vertical form fill seal machines 128 at the vertical form fill seal machine station 116 are associated with an intermediate packaging volume and the gaylords 132 at the gaylord filling station 120 are associated with the largest packaging volume capacity. The packaging modalities depicted in the illustrative embodiment are non-limiting, it being understood that other embodiments may employ additional, lesser or different packaging modalities.

In one embodiment, the control system 122 may be configured to maintain a packaging plan involving multiple destinations. The packaging plan would indicate a parcel packaging station suitable for each destination at any point in time. The packaging plan would be based on the volume of parcels that are being sorted to each destination. Typically, high-volume destinations would be well-suited to the largest available packaging option, e.g., gaylords. The overall volume of parcels sorted to each destination may be determined, for example, by employing a volumetric algorithm based on parcel size, volume, shape, etc. The volume-based method of association limits processing time for items in the system, and therefore optimizes the productivity of the system.

In a further embodiment, the packaging plan may be dynamically adjusted based on an operational condition. An example of an operational condition is a frequency of transportation departure to a given destination. For instance, a higher departure frequency associated with a destination may require a lower volume of parcels sorted to that destination at a time, and hence indicate a smaller packaging option. The opposite may be true when a lower departure frequency is associated with a destination. Since such operational conditions are transient, it may be expected that the packaging plan may change by season and even by time of day.

Figure 3:
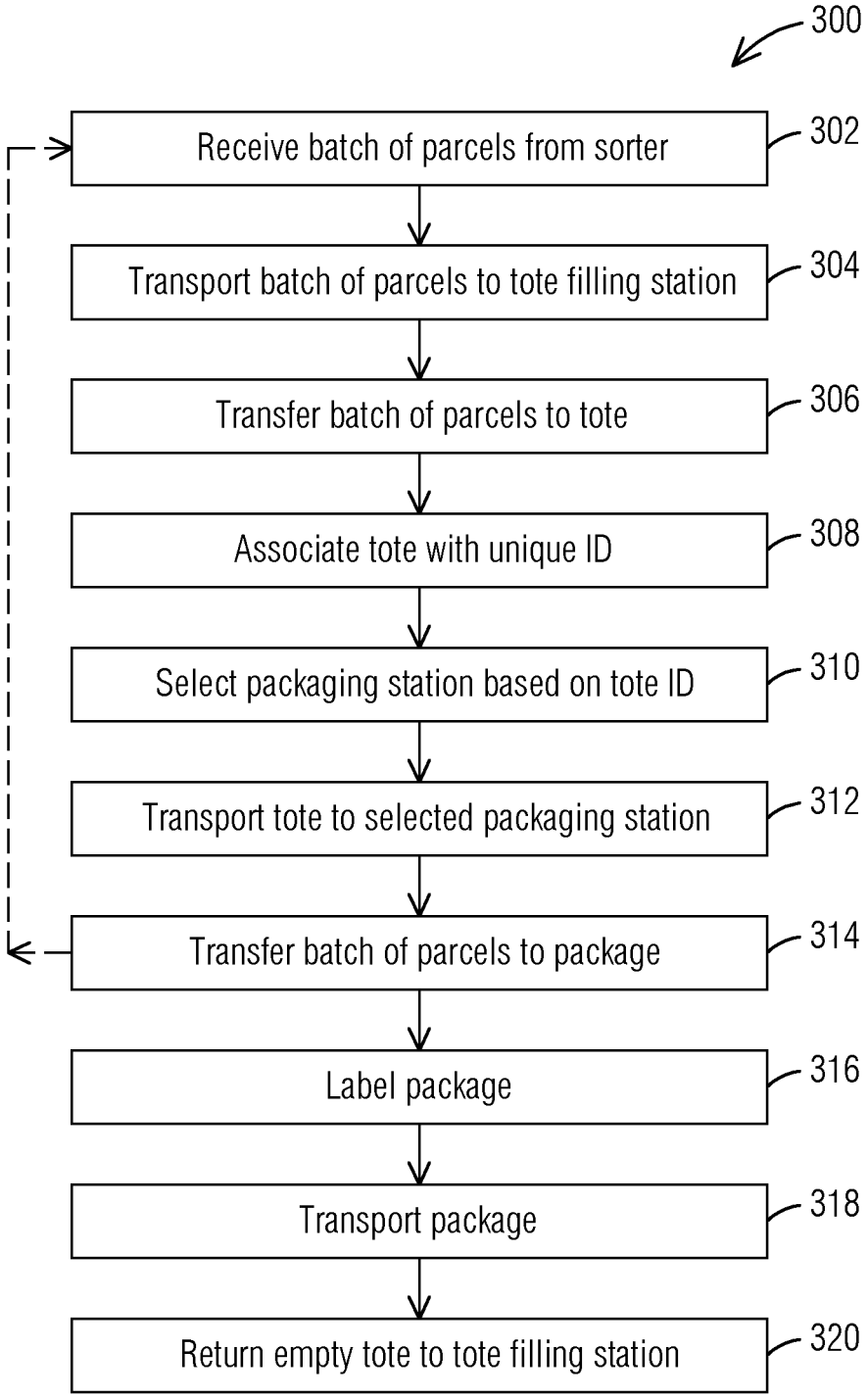
FIG. 3 is a flowchart illustrating a method for packaging parcels according to an aspect of the present disclosure.

FIG. 3 is a flowchart of a method 300 in accordance with disclosed embodiments that can be performed by a parcel packaging system as disclosed herein, referred to generically as the "system." FIG. 3 is not intended to indicate that the operational blocks of the method 300 are to be executed in any particular order, or that all of the blocks of the method 300 are to be included in every case. Additionally, the method 300 can include any suitable number of additional operations. Note that while the example below describes the operations with regard to a single batch of parcels, the system in operation will process multiple batches of parcels in succession.

The method 300 comprises receiving parcels sorted to a common destination in a tote. In the shown embodiment, the above is executed via blocks 302 through 306.

At block 302, the system receives a batch of parcels sorted to a common destination at an intake. As described herein, the intake may comprise a plurality of individually controlled buffers. The system may sort and collect the batch of parcels based on a sorting key assigned to each parcel.

At block 304, the system transports the batch of parcels on a gathering conveyor to a tote filling station.

At block 306, the system transfers the batch of items to a tote at the tote filling station.

In some embodiments, instead of executing blocks 302 through 306, the method may include receiving parcels sorted to a common destination from a sorter directly into a tote. In this case, the parcels may be received individually, one after the other, in the tote, whereby the tote eventually contains a batch of parcels sorted to the common destination.

At block 308, the system associates the tote with a unique identifier linked to information regarding the destination of the batch of parcels. This can be accomplished by reading an identifier on the tote or by labeling the tote with the identifier. The control system may store the identifiers and associations.

At block 310, the system selects a parcel packaging station for the batch of parcels, from a plurality of available parcel packaging stations. The plurality of parcel packaging stations are associated with varying packaging volume capacities. The selected parcel packaging station may be determined based on an overall volume of parcels being sorted to the destination. The system may maintain a packaging plan involving multiple destinations, which indicates a parcel packaging station suitable for each destination. The packaging plan may be used to determine the selected parcel packaging station. The packaging plan may be adjusted dynamically based on an operational condition.

At block 312, the system transports the tote containing the batch of parcels on a tote delivery conveyor to the selected parcel packaging station.

At block 314, the system transfers the batch of parcels to a package at the selected parcel packaging station. The loop depicted by the dashed arrow indicates that in some cases, multiple batches of parcels sorted to a common destination may be transferred to a single package by repeating the above-described operational blocks.

At block 316, the system generates a label for the package. The label identifies a geographic location of the destination. The label may contain additional human-readable information, such as sort location inside the delivery truck, customer name, tracking ID, dimensions and weight of the parcels, etc.

At block 318, the system transports the package for subsequent processing.

At block 320, the system transports the empty tote from the parcel packaging station to the tote filling station on a tote return conveyor.

Figure 4:
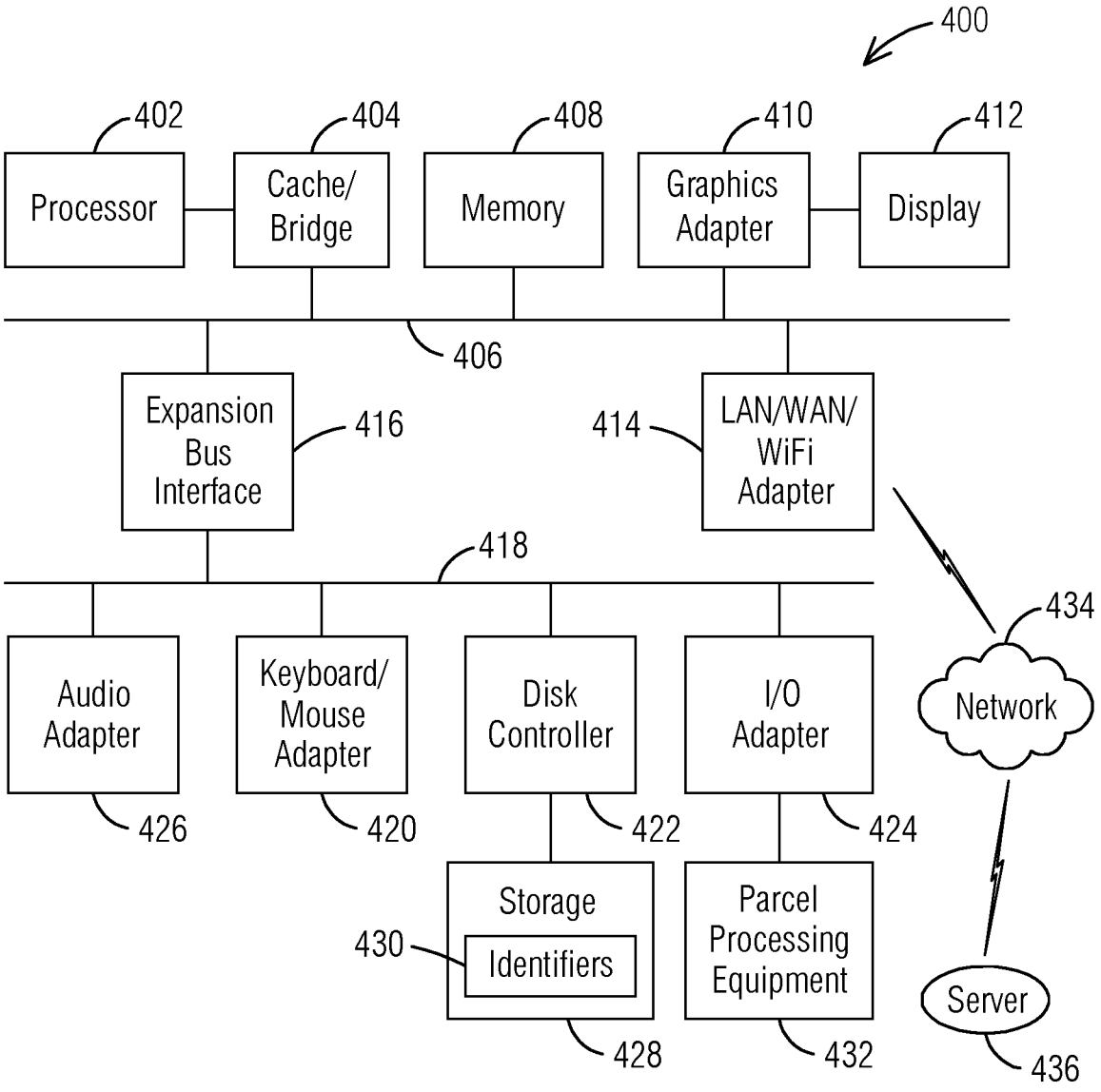
FIG. 4 illustrates a block diagram of a data processing system with which an embodiment can be implemented.

FIG. 4 illustrates a block diagram of a data processing system 400 with which an embodiment can be implemented, for example as control system 122 or other device configured by software or otherwise to perform the processes as described herein, and in particular as each one of a plurality of interconnected and communicating systems as described herein. The data processing system 400 depicted includes a processor 402 connected to a level two cache/bridge 404, which is connected in turn to a local system bus 406. Local system bus 406 may be, for example, a peripheral component interconnect (PCI) architecture bus. Also connected to local system bus 406 in the depicted example are a main memory 408 and a graphics adapter 410. The graphics adapter 410 may be connected to display 412.

Other peripherals, such as a LAN/WAN/Wireless adapter 414, may also be connected to local system I/O bus 418. Expansion bus interface 514 connects local system bus 406 to input/output (I/O) bus 418. I/O bus 418 is connected to keyboard/mouse adapter 420, disk controller 422, and I/O adapter 424. Disk controller 422 can be connected to a storage 428, which can be any suitable machine usable or machine readable storage medium, including but not limited to nonvolatile, hard-coded type mediums such as read only memories (ROMs) or erasable, electrically programmable read only memories (EEPROMs), magnetic tape storage, and user-recordable type mediums such as floppy disks, hard disk drives and compact disk read only memories (CD-ROMs) or digital versatile disks (DVDs), and other known optical, electrical, or magnetic storage devices. Storage 428 can store any data or executable instructions useful in performing processes as described herein, including in particular the identifiers 430 discussed above.

I/O adapter 424 is connected to control parcel processing equipment 432, which can be any of the elements illustrated in FIGS. 1 and 2.

Also connected to I/O bus 418 in the example shown is audio adapter 426, to which speakers (not shown) may be connected for playing sounds. Keyboard/mouse adapter 420 provides a connection for a pointing device (not shown), such as a mouse, trackball, trackpointer, touchscreen, etc.

Those of ordinary skill in the art will appreciate that the hardware depicted in FIG. 4 may vary for particular implementations. For example, other peripheral devices, such as an optical disk drive and the like, also may be used in addition or in place of the hardware depicted. The depicted example is provided for the purpose of explanation only and is not meant to imply architectural limitations with respect to the present disclosure.

A data processing system in accordance with an embodiment of the present disclosure includes an operating system employing a graphical user interface. The operating system permits multiple display windows to be presented in the graphical user interface simultaneously, with each display window providing an interface to a different application or to a different instance of the same application. A cursor in the graphical user interface may be manipulated by a user through the pointing device. The position of the cursor may be changed and/or an event, such as clicking a mouse button, generated to actuate a desired response.

One of various commercial operating systems, such as a version of Microsoft Windows™ a product of Microsoft Corporation located in Redmond, Wash. may be employed if suitably modified. The operating system is modified or created in accordance with the present disclosure as described.

LAN/WAN/Wireless adapter 414 can be connected to a network 434 (not a part of data processing system 400), which can be any public or private data processing system network or combination of networks, as known to those of skill in the art, including the Internet. Data processing system 400 can communicate over network 434 with server system 436, which is also not part of data processing system 400, but can be implemented, for example, as a separate data processing system 400.

Those skilled in the art will recognize that, for simplicity and clarity, the full structure and operation of all systems suitable for use with the present disclosure is not being depicted or described herein. Instead, only so much of the physical systems as is unique to the present disclosure or necessary for an understanding of the present disclosure is depicted and described. The remainder of the construction and operation of the systems disclosed herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of a instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs). In particular, computer readable mediums can include transitory and non-transitory mediums, unless otherwise limited in the claims appended hereto.

The system and processes of the figures are not exclusive. Other systems and processes may be derived in accordance with the principles of the disclosure to accomplish the same objectives. Although this disclosure has been described with reference to particular embodiments, it is to be understood that the embodiments and variations shown and described herein are for illustration purposes only. Modifications to the current design may be implemented by those skilled in the art, without departing from the scope of the disclosure.

What is claimed is:

1. A system for packaging parcels, comprising:

a sorter configured to sort parcels by destination, a tote for receiving a batch of parcels sorted to a common destination from the sorter, a plurality of parcel packaging stations associated with varying packaging volume capacities, a tote delivery conveyor configured to provide transport links to the plurality of parcel packaging stations, for transporting the tote thereto, wherein the system is configured to select a parcel packaging station for the batch of parcels, from the plurality of parcel packaging stations, based on an overall volume of parcels being sorted to said destination, and wherein the tote delivery conveyor is controllable to transport the tote containing the batch of parcels to the selected parcel packaging station.

2. The system of claim 1 further comprising:

an intake configured to receive the batch of parcels sorted to the common destination from the sorter, a gathering conveyor configured to transport the batch of parcels from the intake to a tote filling station, for transferring the batch of parcels to the tote.

3. The system of claim 2, wherein the intake comprises a plurality of individually controlled buffers.

4. The system of claim 1, wherein the system is configured to associate the tote containing the batch of parcels with a unique identifier linked to information regarding the destination of the batch of parcels.

5. The system of claim 1, wherein, at the selected parcel packaging station, the system is configured to transfer the batch of parcels from the tote into a package for subsequent handling.

6. The system of claim 5, wherein the system is configured to transfer multiple batches of parcels associated with said destination into said package.

7. The system of claim 5, wherein the system is configured generate a label for the package, the label identifying at least a geographic location of the destination.

8. The system of claim 1, comprising a tote return conveyor configured to transport an empty tote from the parcel packaging stations to the tote filling station.

9. The system of claim 1, wherein the plurality of parcel packaging stations are selected from the group consisting of: a vertical form fill seal machine station, a bagging station and a gaylord filling station.

10. The system of claim 1, wherein the system is configured to maintain a packaging plan involving multiple destinations, the packaging plan indicating a parcel packaging station suitable for each destination.

11. The system of claim 10, wherein the system is configured to dynamically adjust the packaging plan based on an operational condition.

12. A method for packaging parcels, comprising:

receiving, in a tote, a batch of parcels sorted to a common destination by a sorter, and transporting the tote containing a batch of parcels sorted to the common destination on a tote delivery conveyor to a selected parcel packaging station from a plurality of parcel packing stations, wherein the plurality of parcel packaging stations are associated with varying packaging volume capacities, and wherein the selected parcel packaging station is determined based on an overall volume of parcels being sorted to said destination.

13. The method of claim 12, comprising associating the tote containing the batch of parcels with a unique identifier linked to information regarding the destination of the batch of parcels.

14. The method of claim 12, comprising, at the selected parcel packaging station, transferring the batch of parcels from the tote into a package for subsequent handling.

15. The method of claim 14, comprising transferring multiple batches of parcels associated with said destination into said package.

16. The method of claim 14, comprising generating a label for the package, the label identifying at least a geographic location of the destination.

17. The method of claim 12, comprising transporting an empty tote from the parcel packaging stations to the tote filling station on a tote return conveyor.

18. The method of claim 12, wherein the plurality of parcel packaging stations are selected from the group consisting of: a vertical form fill seal machine station, a bagging station and a gaylord filling station.

19. The method of claim 12, comprising maintaining a packaging plan involving multiple destinations, the packaging plan indicating a parcel packaging station suitable for each destination.

20. The method of claim 19, comprising dynamically adjusting the packaging plan based on an operational condition.

* * * * *